US007255649B1

(12) United States Patent
McConnell

(10) Patent No.: US 7,255,649 B1
(45) Date of Patent: Aug. 14, 2007

(54) GOLF PUTTING DISTANCE CONTROL TRAINING DEVICE

(75) Inventor: William Dean McConnell, 3205 Ridge Oak Dr., Garland, TX (US) 75044

(73) Assignee: William Dean McConnell, Garland, TX (US)

( * ) Notice: Subject to any disclaimer, the term of this patent is extended or adjusted under 35 U.S.C. 154(b) by 653 days.

(21) Appl. No.: 10/675,366

(22) Filed: Sep. 30, 2003

Related U.S. Application Data

(60) Provisional application No. 60/418,943, filed on Oct. 16, 2002.

(51) Int. Cl.
*A63B 57/00* (2006.01)
*A63B 69/36* (2006.01)

(52) U.S. Cl. ..... 473/199; 473/222

(58) Field of Classification Search ..... 473/265, 473/151, 199, 145, 222
See application file for complete search history.

(56) References Cited

U.S. PATENT DOCUMENTS 4,180,270 A 12/1979 Long
5,246,232 A * 9/1993 Eccher et al. ..... 473/199
5,486,002 A * 1/1996 Witler et al. ..... 473/199
5,788,583 A 8/1998 Agulnek et al.
6,146,283 A 11/2000 Ferguson, III
6,540,620 B1 4/2003 Consiglio

* cited by examiner

*Primary Examiner*—R. Laneau
*Assistant Examiner*—Omkar A. Deodhar

(57) ABSTRACT

A golf putting training device is provided which allows a golfer to practice distance control in a confined area by displaying an estimate of how far a golf ball would have traveled on a green having a selected stimp value after being struck with a putter and subsequently colliding with a target strike plate of the training device. The golf putting training device includes a housing and rear stabilization plate, a target strike plate, a doppler microwave speed sensor, an impact sensor, a green speed selector, a distance display, an audible beeper, and a microcontroller which calculates the putting distance based on the measurement of the speed of the rolling golf ball prior to impact and the stimp setting selected. An audible beeper provides an indication of the rolling progress of the simulated roll of the golf ball past the target strike plate.

4 Claims, 10 Drawing Sheets

GOLF PUTTING DISTANCE CONTROL TRAINING DEVICE

CROSS REFERENCE TO RELATED APPLICATIONS

This application claims the benefit of provisional application Ser. No. 60/418,943, filed on Oct. 16, 2002.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to golf training devices and more specifically to a golf putting training device that allows a golfer to practice putting a golf ball a precise distance in a very small area. In the game of golf, at least half of the strokes allocated to comprising the par for 18 holes are for putting. The putter is the club used most in a round of golf. Putting is the game within the game of golf that greatly affects the golfer's overall score. The most common problem associated with putting in a round of golf is the three-putt. After hitting an iron onto the green in regulation 25 feet from the hole, the golfer strokes the first putt either far short of the hole or far past the hole leaving a par putt of 6 feet or more. Most often, an average golfer will miss putts of more than 6 feet. Therefore, to eliminate three putts, a golfer must stroke the first putt 3 feet or closer from the hole to assure making the next putt. There are two components that comprise putting. They are distance and direction. Professional golf instructors know that in putting, distance is more important than direction. Therefore, average golfers can improve their putting ability by learning to hit long putts a precise distance ensuring that the remaining putt is a short tap-in. Practicing long putts is difficult due to many factors. It is sometimes difficult to find a practice green that is relatively flat for 20 feet or more. If the practice green is busy, it is difficult to find a path to a hole 20 feet or more that does not cross the path of another golfer practicing. Most golfers don't have the time to travel to a golf facility just to practice long putts. When they do go to the golf course for practice, they would rather hit drives and iron shots. A putting distance control training device that can be used indoors at home or in the office requiring only a very small space would allow a golfer to improve first putt distance control and thus improve overall scoring.

A variety of golf putting training devices have been developed to aid golfers in putting a golf ball a desired distance. For example, U.S. Pat. No. 5,788,583 discloses a system which predicts the distance that a golf ball will travel when struck by a putter head during a putting swing. The golfer swings the putter head over two optical sensors located a predetermined distance from each other. A timer generates a time difference value representing a difference between the time when the putter head travels over the first sensor and a second time when the putter head travels over the second sensor. A microprocessor determines the predicted distance by using the time difference measurement and green condition settings set by the golfer to fetch a predicted distance value from a lookup table predefined in memory. The golfer continues taking practice strokes until the predicted distance matches the actual distance to the hole. This approach uses as its basis for golf ball distance estimation, the speed of the putter head during a practice stroke. In order to relate putter head speed to predicted golf ball distance, a lookup table is employed whose values are determined empirically through a data acquisition process. This process is performed by repeatedly placing a golf ball near the sensors, striking the ball with a putting stroke, recording the putter head time difference value, and then measuring and recording the actual distance that the ball rolled on the green. By repeating this process for several more practice strokes, the lookup table contents can be determined for a specific putt on a specific green. U.S. Pat. No. 5,788,583 requires a large amount of empirical data to be entered prior to using the device as a trainer and each data set entered covers one particular distance putt.

U.S. Pat. No. 6,146,283 discloses a system which assists golfers in practicing their respective putting stroke by indicating the distance a practice putt would have traveled upon a simulated green having a selected stimp value. The practice device employs a pair of putting targets mounted to a rotatable putting force sensor at opposite ends so as to counterbalance one another. The putting target is struck by a putter during a practice stroke resulting in the counterbalanced putting targets spinning along the axis of the stroke. The simulated speed of a golf ball is determined by relating the rotations per second of the putting force sensor to linear velocity. The linear velocity has a mass correction factor applied if the inertial mass of the counterbalanced putting targets differ significantly from that of a single golf ball. Finally, a microprocessor calculates the estimated distance based on the measured rotational speed and the stimp green speed selector setting.

U.S. Pat. No. 4,180,270 discloses a putting training apparatus which includes two retractable sensors flanking an imaginary golf ball. By swinging a putter at the imaginary ball, the first and second sensors are actuated and, based on which of the two sensors was actuated first, determines if the putter was open or closed at impact. The time difference in the two sensor actuations determines the direction accuracy of the golfer's putting stroke. A second embodiment of this patent employs a third and fourth sensor that actuate at a fixed distance from the two direction sensors. Using the time measured from the first two sensor actuations to the third and fourth sensor actuations, a distance estimate is made.

U.S. Pat. No. 5,788,583, U.S. Pat. No. 6,146,283, and U.S. Pat. No. 4,180,270 all predict the distance that a golf ball will roll. However, none in their basic mode of operation requires the striking and subsequent roll of a golf ball. Furthermore, none of the cited patents make direct speed measurements of a rolling golf ball during their use as training devices. Empirical data tables and mass correction factors are employed to model the predicted behavior of a golf ball struck by a putter.

U.S. Pat. No. 6,540,620 discloses a golf putter training device which aids a golfer in judging the speed of impact of a golf club head upon a ball. A golf ball is struck by a putter into an elongated structure equipped with a pair of optical sensors that measure the travel time of the golf ball as it passes from the first to the second sensor pair. The resulting count value is presented to a digital to analog converter whose output connects to a digital panel meter for display to the golfer. The number presented to the golfer is not a prediction of the golf ball roll distance but a relative indication of the force of impact so that the golfer can learn to repeat the same force stroke.

BRIEF SUMMARY OF THE INVENTION

The primary object of the invention is to provide a golf putting training device which allows golfers to improve their putting distance control.

Another object of the invention is to provide a golf putting training device which accurately informs the golfer of the distance that the golf ball would have rolled on a green with a specified stimp value.

Another object of the invention is to provide a golf putting training device that is portable and allows a golfer to practice long putts in a small area very efficiently due to not having to retrieve the ball from a distance.

Yet another object of the invention is to provide a golf putting training device that allows a golfer to actually strike a golf ball and based on the rolling ball's direct measured speed, display the distance that the ball would have rolled on a green while also providing audio feedback as to the rolling time of the ball.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a golf putting distance control training device comprising: a housing, a target strike plate backed with impact absorbing material mounted to the front side of the housing which serves as a putting target and receives the impact of a rolling golf ball, an impact detection sensor responsive to the collision of the rolling golf ball with the strike plate, circuitry for the amplification of the impact detection sensor signal and conversion to an impact sensor digital signal, a doppler microwave speed measurement sensor responsive to the movement of the rolling golf ball by providing an audio signal output whose frequency is proportional to the speed of the ball, circuitry for the amplification of the doppler microwave speed measurement sensor signal and conversion to a digital signal, a green speed setting switch to allow the golfer to select the speed of the simulated green, a microcontroller to receive the doppler microwave speed measurement sensor digital signal, the impact sensor digital signal, and the green speed setting switch, and calculate and output an estimated ball roll distance to inform the golfer of the distance that the rolling golf ball would have traveled past the strike plate and an audible beeper to provide the golfer with an audible indication of the progress of the simulated rolling ball.

BRIEF DESCRIPTION OF THE DRAWINGS

The drawings constitute a part of this specification and include exemplary embodiments to the invention, which may be embodied in various forms.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
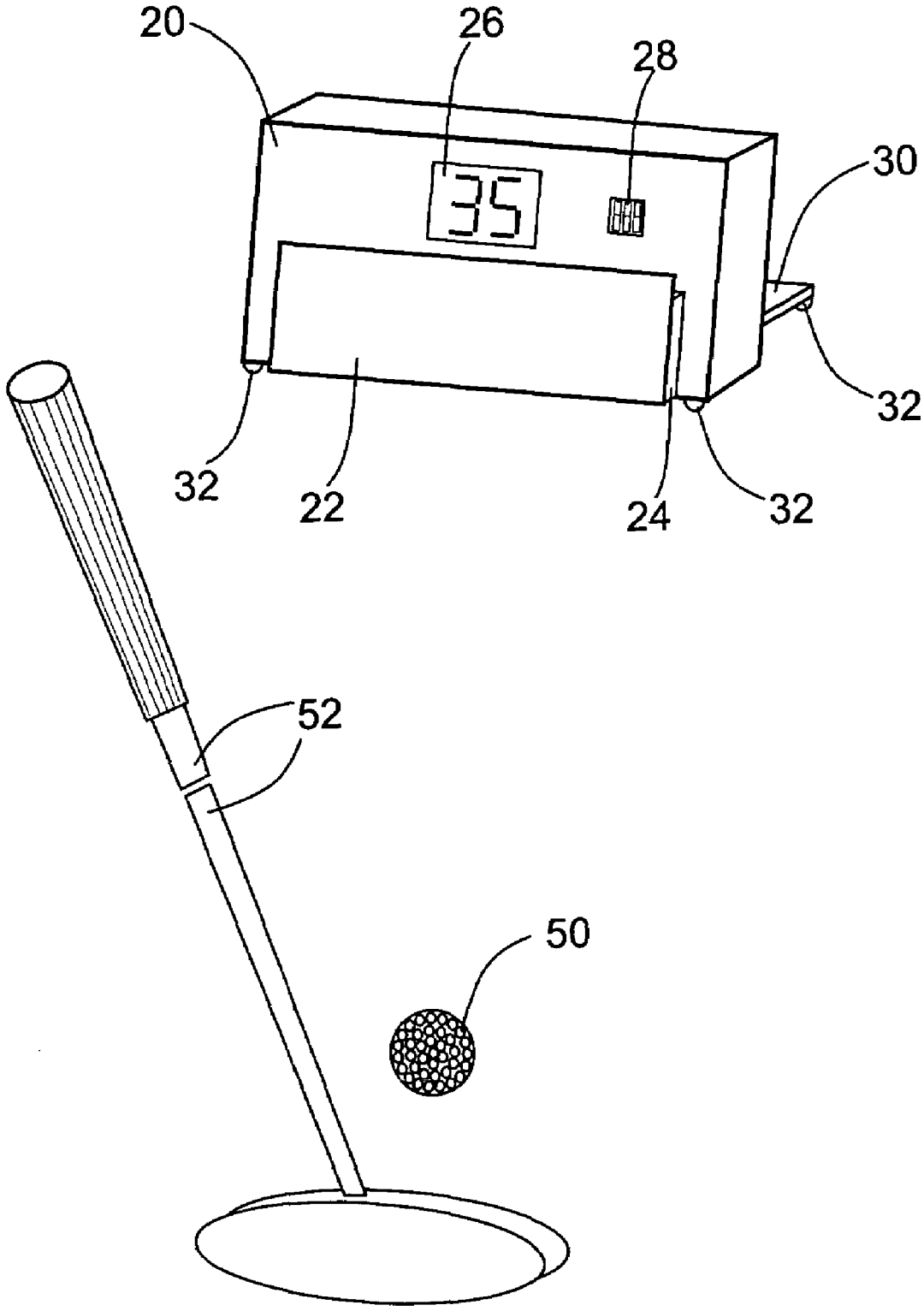
FIG. 1 is a perspective view of the putting distance control trainer device.
Figure 2:
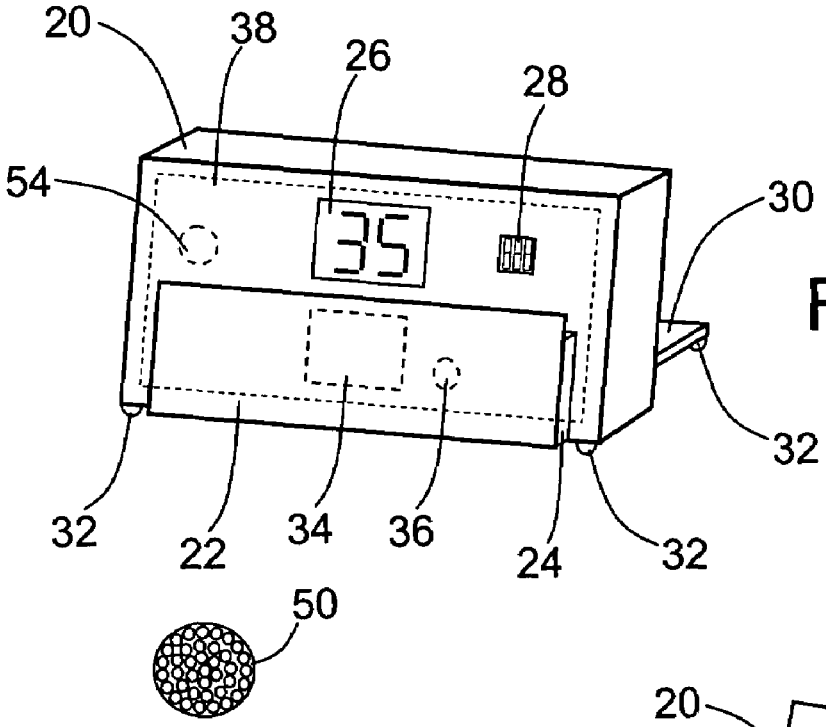
FIG. 2 is a perspective view of the putting distance control trainer device showing the interior mounted dopper microwave speed sensor, audible beeper, impact detection microphone sensor, and printed circuit board parts in broken lines.
Figure 3:
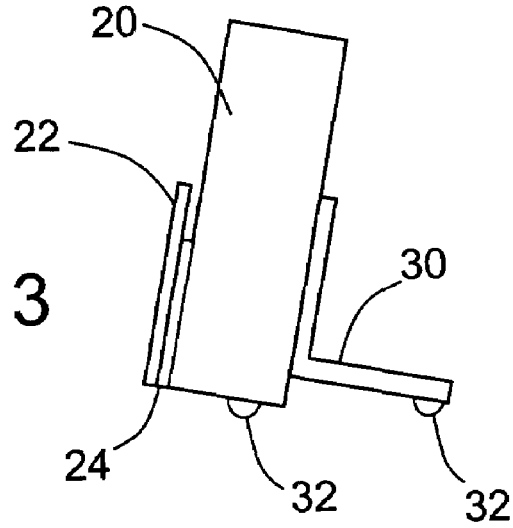
FIG. 3 is a side elevation of the putting distance control trainer device showing the strike plate, impact absorbing material layer, bumpers, and rear stabilizing plate.
Figure 4:
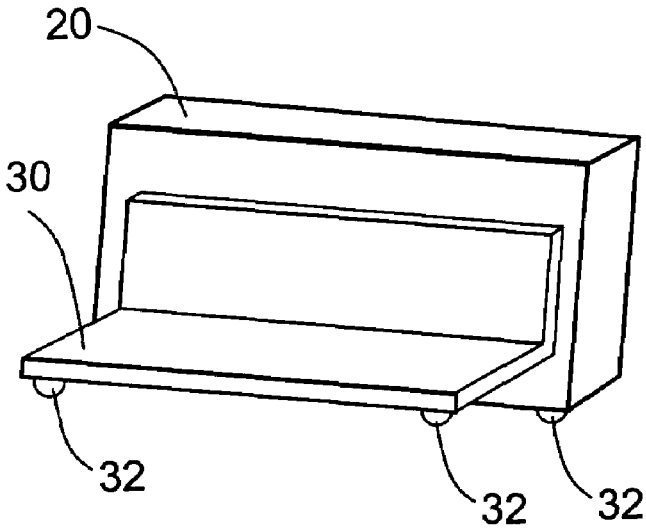
FIG. 4 is a rear perspective view of the putting distance control trainer device showing the rear stabilizing plate and bumpers.

Referring to the drawings, a golf putting training device is indicated generally in FIG. 1. As indicated in FIG. 1, a golfer (not shown) strokes golf ball 50 with putter 52 approximately two feet from golf putting distance control training device housing 20 in the direction of the center of target strike plate 22. Golf ball 50 and housing 20 are preferably placed on carpeted floor comprised of short fibers to provide a fast true roll. Impact absorbing foam material 24 is located behind target strike plate 22 in order to reduce the subsequent collision recoil. Housing 20 preferably is weighted with a material that is heavy enough to provide positional stabilization during impact of rolling golf ball 50 with strike plate 22. Rear stabilization plate 30 further aids in positional stabilization. In this embodiment, a steel plate (not shown) mounted to the interior back side of housing 20 provides sufficient weight to hold the housing in place during impact. However, the construction material is not limited to steel. Bumpers 32 attached to the bottom of housing 20 and rear stabilization plate 30 hold housing 20 in place during ball impact (back left bumper not shown). Green speed setting dipswitch 28 selects the green speed and display 26 communicates the estimated ball roll distance in feet to the golfer. As shown in FIG. 2, doppler microwave speed sensor 34, microphone impact detection sensor 36, and audible beeper 54 are located inside housing 20 mounted onto printed circuit board 38. The preferred material for housing 20 is plastic to allow for doppler microwave speed sensor 34 to propagate a transmit signal toward rolling golf ball 50 and receive a doppler-shifted return signal from rolling golf ball 50 through housing 20. After impact of rolling golf ball 50 with target strike plate 22, the distance that the golf ball would have traveled past strike plate 22 is communicated to the golfer on display 26. In this embodiment, display 26 is a two digit 7-segment display. It will be understood by those skilled in the art that other golfer communication means, such as a Liquid Crystal Display or an audible speech integrated circuit, or a personal computer interfaced through a serial interface could be used in place of the 7-segment display to communicate the estimated ball roll distance to the golfer. Using the putting distance control trainer device repeatedly, the golfer can learn to putt a ball for example, 15, 25, or 45 feet in length consistently. Referring to FIG. 3 and FIG. 4, rear stabilization plate 30 is mounted to the back side of housing 20 approximately one half inch from the bottom which results in a housing upward tilt of approximately 7 degrees when the golf putting distance control trainer device is placed on the floor. The upward tilt reduces ball recoil at impact and also aids in golfer viewing of display 26 (shown in FIG. 2). A total of four bumpers 32 are mounted to the bottom of housing 20 and rear stabilization plate 30 which provide a high frictional contact with the floor.

Figure 5:
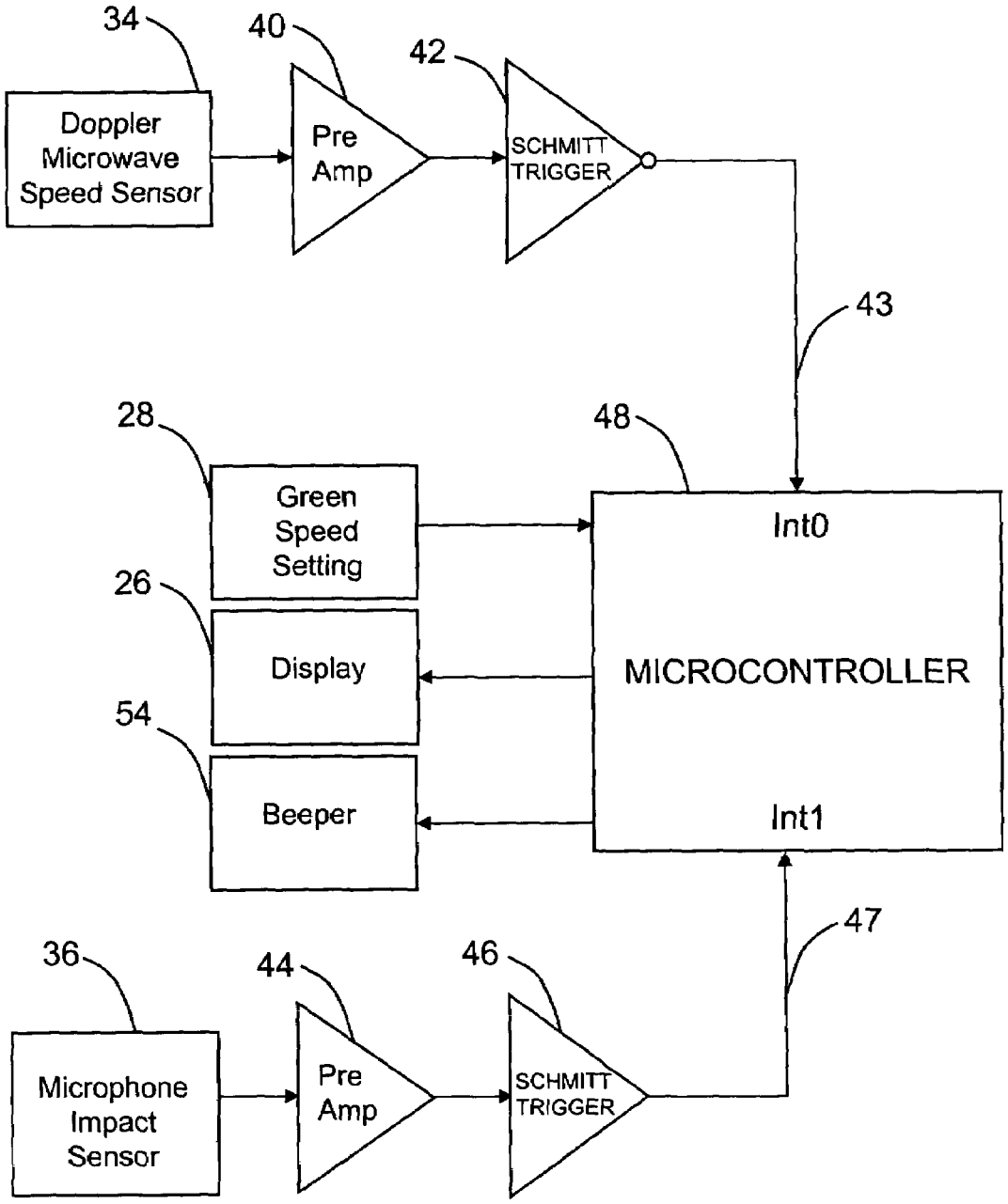
FIG. 5 is a schematic block diagram of the major electronic elements of the putting distance control trainer device.

The golf putting training device is comprised of the major electronic elements shown in FIG. 5. These include doppler microwave speed sensor 34 and associated preamplifier 40 and schmitt trigger 42, microphone impact sensor 36 and associated preamplifier 44 and schmitt trigger 46, microcontroller 48, green speed setting switch 28, display 26 for communicating distance information to the golfer, and audible beeper 54 for communicating simulated ball roll progress to the golfer. The output of schmitt trigger 42 is the INT0 43 digital signal that interrupts microcontroller 48. The output of schmitt trigger 46 is the INT1 47 digital signal that interrupts microcontroller 48 when an impact of golf ball 50 (shown in FIG. 1) with target strike plate 22 (also shown in FIG. 1) occurs.

Figure 6:
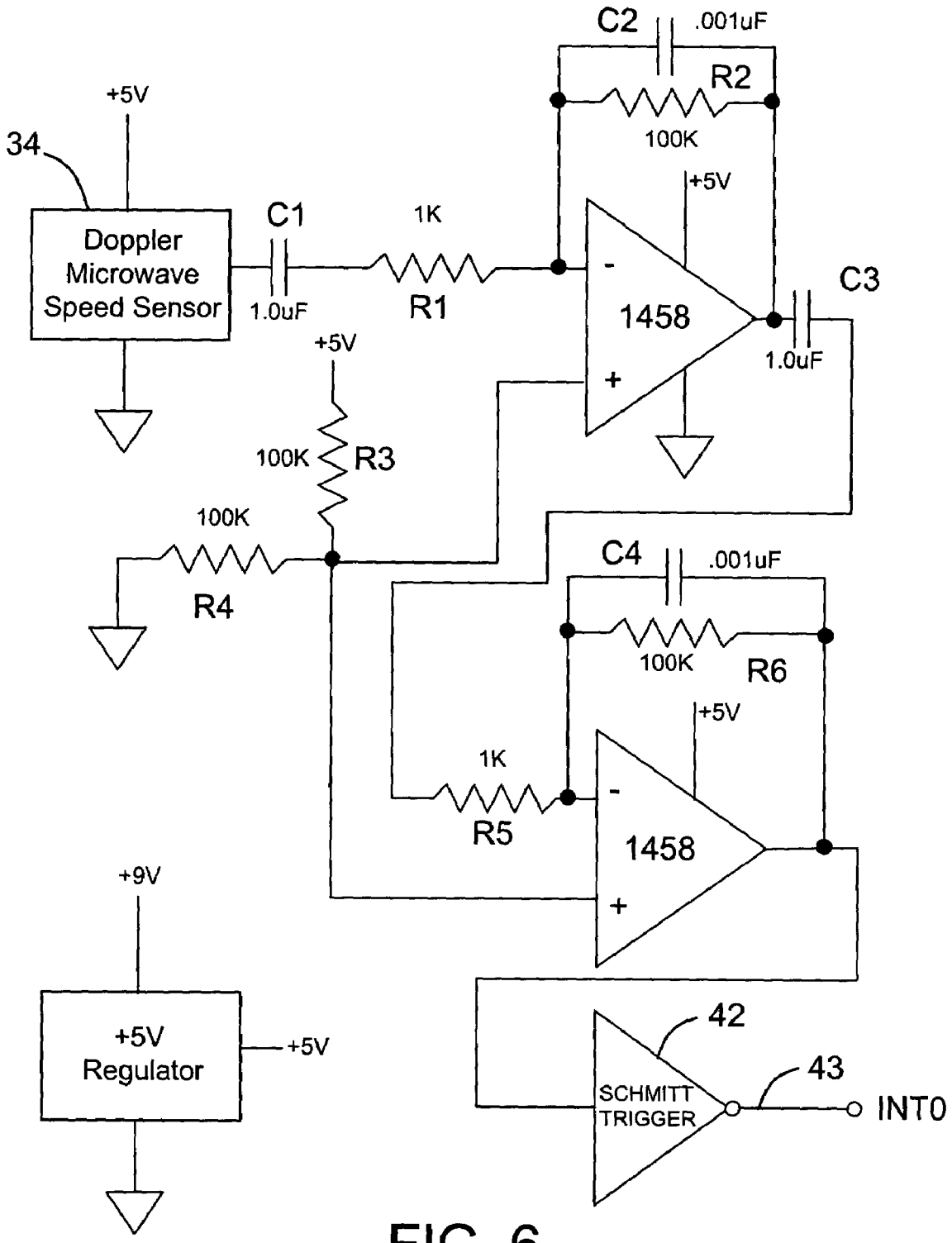
FIG. 6 is an electrical schematic of the doppler microwave speed sensor, preamplifier, and schmitt trigger output signal.

The putting distance control trainer device includes doppler microwave speed sensor 34 for providing a direct indication of the speed of the golf ball as it travels towards target strike plate 22 (shown in FIG. 2). Accordingly, doppler microwave speed sensor 34 comprises a commercially available doppler microwave speed sensor responsive to the movement of an object such as a rolling golf ball. Doppler microwave speed sensor 34 outputs an audio-band signal whose frequency is proportional to the speed of the object in its beam. A specific scale factor of cycles per second per feet per second is associated with the particular frequency band of the device. For the particular X-band device used in this embodiment, the scale factor is 21.4 Hz per feet per second. Doppler microwave speed sensor 34, is followed by signal amplification preamplifier 40. As shown in FIG. 6, the output of doppler microwave speed sensor 34 is capacitive coupled through C1 to input resistor R1 of the first stage of an operational amplifier such as a commercially available National Semiconductor LM1458. The amplifier, used in an inverting configuration, includes feedback resistor R2 and high frequency roll off capacitor C2. A bias voltage level is applied to the non-inverting input of the amplifier through a voltage divider network formed from R3 and R4 to set the output voltage to 2.5 volts. The output of the first stage amplifier is capacitor coupled through C3 to the second stage amplifier through input resistor R5. The second stage amplifier is also biased at the non-inverting input by the voltage divider network to 2.5 volts. The second stage amplifier includes feedback resistor R6 and high frequency roll off capacitor C4. The output of the second stage amplifier is direct coupled to the input of schmitt trigger 42. Schmitt trigger 42 provides a conversion from an analog signal to a digital signal, INT0 43. The digital output signal of the schmitt trigger is connected to the INT0 input of microcontroller 48 (shown in FIG. 5). When the INT0 signal 43 transitions from a digital high state to a digital low state, microcontroller 48 (shown in FIG. 5) software program is interrupted and program control is switched to a microwave speed sensor interrupt service routine. After the completion of the execution of microwave speed sensor interrupt service routine, control of the program returns to the location that was executing prior to the interrupt occurrence.

Referring to FIG. 6, a voltage regulator converts conventional 110 VAC to +9 VDC DC power supply module (not shown) +9V output power to +5V used by the putting distance control trainer device electronic circuitry.

Figure 7:
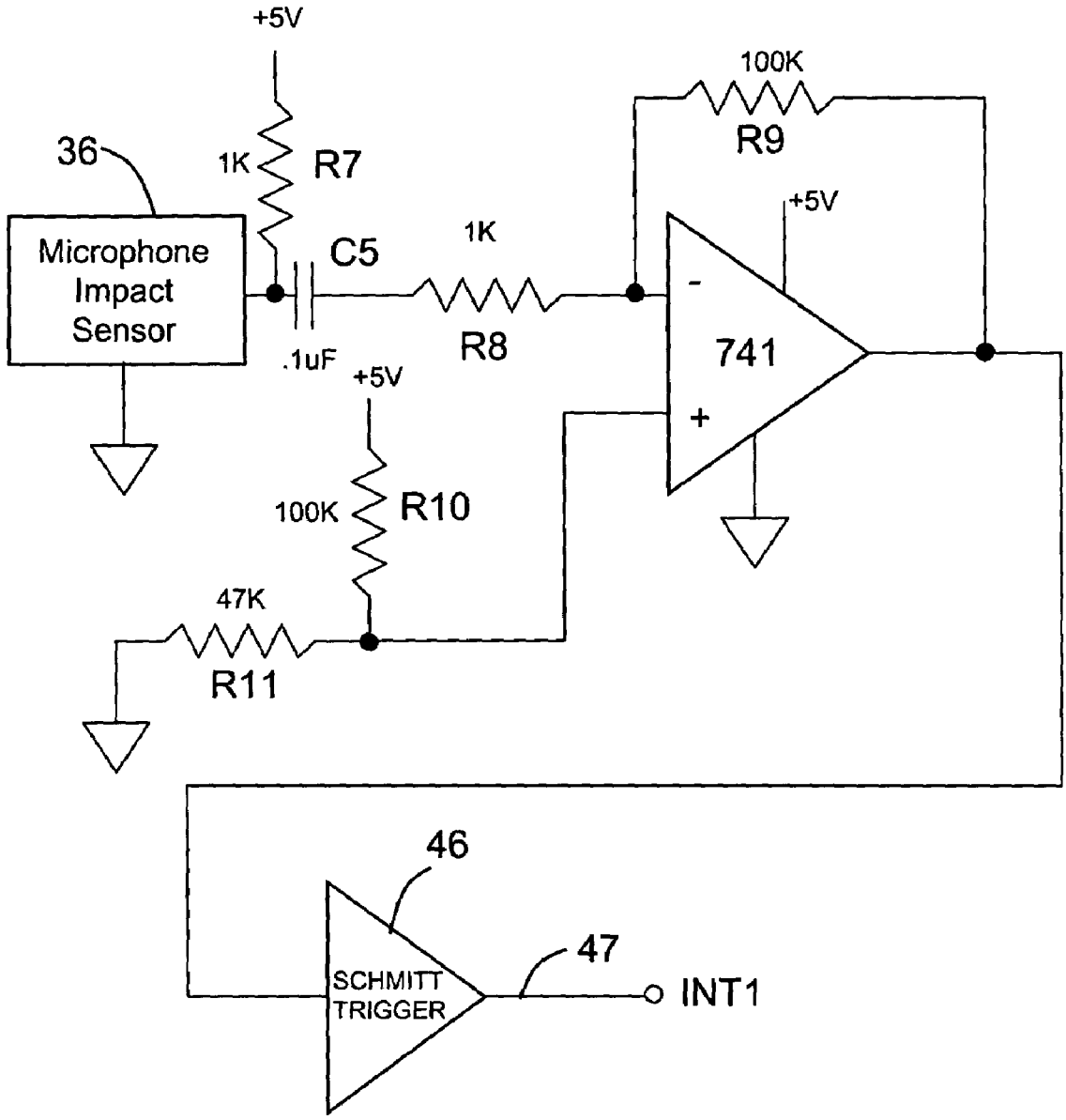
FIG. 7 is an electrical schematic of the microphone impact detection sensor, preamplifier, and schmitt trigger output signal.
Figure 10:
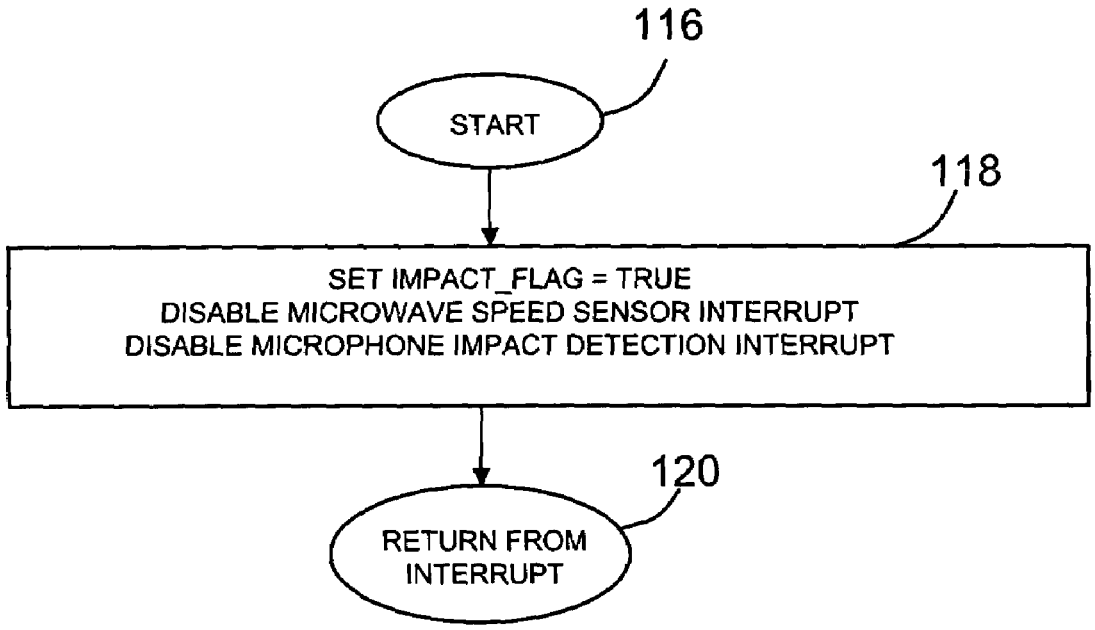
FIG. 10 is a flow chart of the operations that comprise the microcontroller software processing of the microphone impact sensor interrupt service routine.

Referring to FIG. 2 and FIG. 3, target strike plate 22 provides an impact noise when struck by rolling golf ball 50. Located between target strike plate 22 and housing 20 is a layer of impact absorbing material 24 which absorbs the impact of the ball with target strike plate 22 and reduces ball recoil. Impact detection microphone sensor 36 is mounted on printed circuit board 38 within housing 20. Referring to FIG. 7, microphone impact sensor 36 is biased through resistor R7 to +5V, and is capacitive coupled through C5 to the inverting input of a commercially available National Semiconductor LM741 operational amplifier through resistor R8. The amplifier includes a feedback resistor R9. A bias voltage level formed by R10 and R11 is applied to the non inverting input of the amplifier. The output of the amplifier is direct coupled to the input of schmitt trigger 46. The schmitt trigger 46 converts the analog microphone signal to the INT1 47 digital signal which is presented to the INT1 interrupt of microcontroller 48 (shown in FIG. 5). When an impact of rolling golf ball 50 (shown in FIG. 2) occurs with target strike plate 22 (shown in FIG. 2), a digital pulse appears at the INT1 interrupt pin of microcontroller 48 (shown in FIG. 5). When the INT1 signal transitions from a digital high to a digital low state, microcontroller 48 (shown in FIG. 5) software program is interrupted and program control is switched to a microphone impact interrupt service routine 116 (shown in FIG. 10). After the completion of the execution of microphone impact interrupt service routine 116 (shown in FIG. 10), control of the program returns, in step 120 of FIG. 10, back to the location that was executing prior to the interrupt occurrence.

Referring to FIG. 2, display 26 communicates the estimated rolling golf ball travel distance information in feet to the golfer. Green speed setting 28 switch determines the speed of the green that will be simulated in the calculation of distance, and is comprised of a three position dipswitch mounted on printed circuit board 38 and accessible through a cutout area in the front of housing 20. The green speed setting allows the golfer to simulate greens from a stimp value of 5.0 to a stimp value of 12.0 in 1.0 stimp value increments. Knowing the approximate speed of the greens that the golfer will putt on an upcoming round allows the golfer to practice under similar circumstances with the putting distance control trainer.

Referring to FIG. 5, microcontroller 48 coordinates the putting distance control trainer distance estimation process and presents the ball roll distance to the golfer for viewing on display 26. Microcontroller 48 is programmed to perform control and coordination of signal interrupts, timing, mathematical calculations, display of the distance information, and audible output of ball roll progress to beeper 54. Three inputs to microcontroller 48 provide the information necessary to calculate the roll distance estimate. These include the microwave speed sensor interrupt INT0 43, the microphone impact signal interrupt INT1 47, and the green speed setting switch 28.

Figure 8:
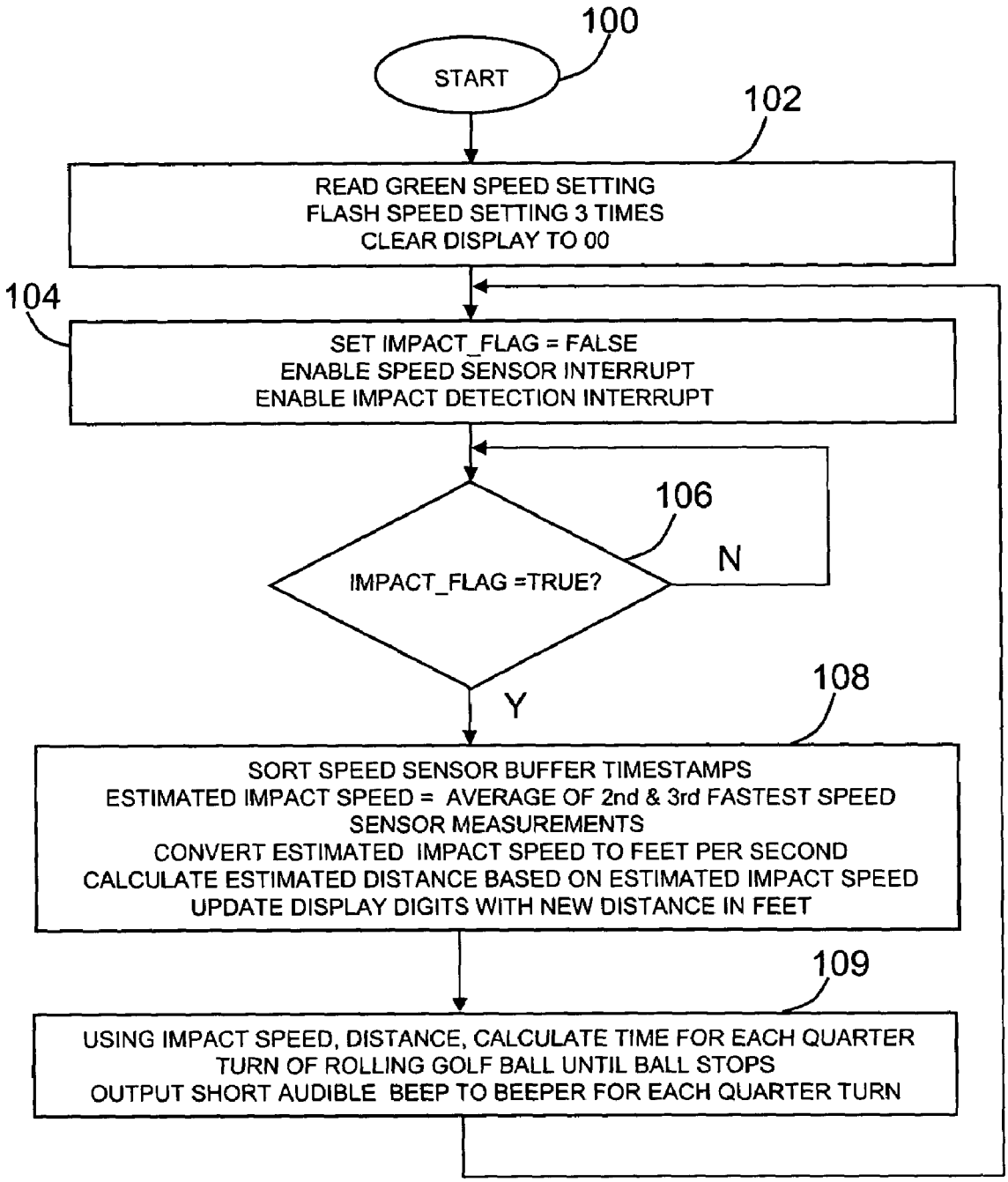
FIG. 8 is a flow chart of the operations that comprise the main background microcontroller software processing.
Figure 9:
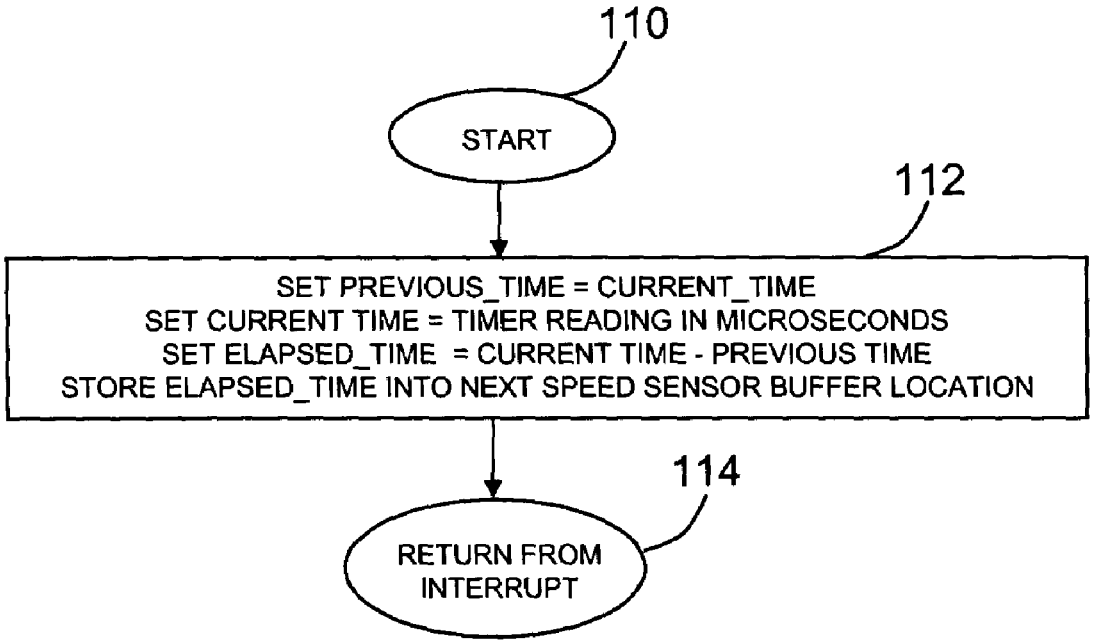
FIG. 9 is a flow chart of the operations that comprise the microcontroller software processing of the doppler microwave speed sensor interrupt service routine.

Referring to FIG. 8, microcontroller software background software 100 starts from power up and in step 102 reads green speed setting dipswitch 28 (shown in FIG. 5), flashes green speed setting on display 26 (shown in FIG. 5) three times and then clears the display to 0 feet. The software variable, IMPACT_FLAG, is cleared to FALSE and microwave speed sensor signal software interrupt and microphone impact detection software interrupts are enabled in step 104. Microcontroller software background software 100) continuously checks IMPACT_FLAG for a TRUE condition in step 106. IMPACT_FLAG can only be set TRUE by the microphone impact interrupt service routine 116 (shown in FIG. 10). While microcontroller software background software is checking IMPACT_FLAG for a TRUE condition in step 106 (shown in FIG. 8), microwave speed sensor interrupt service routine step 110 (shown in FIG. 9) is executed in response to movement of an object in the path of doppler microwave speed sensor 34 (shown in FIG. 5). When microwave speed sensor interrupt INT0 43, (shown in FIG. 5), coupled to the microcontroller INT0 input transitions from high to low, it forces the microcontroller software program to stop current background processing and branch to a software routine specifically written for the INT0 event. Refer to FIG. 9. Microwave speed sensor interrupt service routine software 110 is called in response to the INT0 interrupt. Microwave speed sensor interrupt service routine 110 stores a measured timestamp value into the next location of length n circular speed sensor buffer. The circular memory buffer allows continuous storage of values in a fixed size memory structure such that older values are overwritten with newer ones. In this embodiment, length n is 16, but is not limited to 16. Software variables used in microwave speed sensor interrupt service routine 110 include ELAPSED_TIME, CURRENT_TIME, and PREVIOUS_TIME. These variables are used in the determination of each period of the doppler microwave speed sensor digital signal that is stored in the next speed sensor buffer location. As shown in step 112, the variable PREVIOUS_TIME is set equal to the value stored in CURRENT_TIME. The contents of CURRENT_TIME represents the microcontroller timer value captured during the previous microwave speed sensor interrupt service routine. The variable, CURRENT_TIME, is then set equal to the current timer value. The time between the previous interrupt and the current interrupt is therefore (CURRENT_TIME−PREVIOUS_TIME). This difference value is stored into the variable ELAPSED_TIME and represents the time in microseconds of the most current period of the microwave speed sensor digital signal. Thus, the ELAPSED_TIME timestamps stored in the speed sensor buffer are the periods of each cycle of the microwave speed sensor digital signal representing the movement of rolling golf ball 50 (shown in FIG. 2) on its path to target strike plate 22 (shown in FIG. 2). Microcontroller software in step 112 stores timestamp information into the speed sensor buffer for a cycle, then returns from microwave speed sensor interrupt service routine in step 114 to background software step 106 (shown in FIG. 8). The storage of timestamp data continues indefinitely until a golf ball impact event occurs. Referring to FIG. 2, when impact of rolling golf ball 50 with strike plate 22 occurs, an impact sound is generated which microphone impact sensor 36 senses. Referring to FIG. 5, output signal from microphone impact sensor 36 is amplified and converted to a digital signal that causes an INT1 interrupt of microcontroller 48. Microphone impact detection interrupt service routine 116 (shown in FIG. 10) is called in response to microcontroller 48 (shown in FIG. 5) receiving an INT1 47 (shown in FIG. 5) high to low transition when rolling golf ball 50 (shown in FIG. 2) impacts target strike plate 22 (shown in FIG. 2). Microphone impact detection interrupt service routine 116 (shown in FIG. 10) sets IMPACT_FLAG to TRUE, and disables all microphone impact sensor interrupts and microwave speed sensor interrupts as shown in step 118. Control is returned to microcontroller software background processing as shown in step 120. Referring to FIG. 8, step 106 detects IMPACT_FLAG being set to TRUE by microphone impact detection interrupt service routine and begins the calculation of the distance estimate in step 108. The distance estimation microcontroller software first determines the speed of the ball as it impacted target strike plate 22 (shown in FIG. 2). This is done by starting at the last stored timestamp location in the length n circular buffer and working backward in time to access the last n/2 timestamps. The last n/2 timestamps are then sorted from shortest to longest period length. The second and third shortest timestamps, which represent the fastest two valid single cycle speeds, are averaged to represent the composite period of the microwave speed sensor digital signal at impact. The reciprocal of this value is the frequency in cycles per second of the microwave speed sensor digital signal at impact. Transforming this quantity to a feet per second quantity requires application of a scaling factor associated with the specific microwave sensor used. For the X-band device used in the preferred embodiment, the scale factor is 21.4 Hz per feet per second. Using scale factor 21.4 Hz/ft/sec, the speed of the ball just prior to impact is (1/composite period)/21.4 Hz/ft/sec Applying Newton's second law f=ma, the distance a ball travels with initial velocity v over a surface with coefficient of friction $\mu$ is $(v^2)/(2\ g\mu)$, where g is the gravitational acceleration constant (approximately 32.19 ft/sec$^2$). Knowing the velocity v, and the coefficient of friction $\mu$, the distance can be determined. However, in order to calculate the distance based on a stimp value, the stimp number must first be related to the coefficient of friction.

The stimpmeter is a device that is basically a 36 inch long metal bar with a V-shaped trough which is slowly raised to an angle of 20 degrees. A golf ball is placed in a notch 6 inches from the raised end. The ball releases from the notch when the stimpmeter is raised to 20 degrees. The ball then rolls down the inclined plane until it reaches the surface of the green. The distance in feet that the ball rolls from the bottom of the stimpmeter to where it stops on the green is the stimp value for the green. The area chosen for the measurement must be relatively flat and an average of three rolls is taken provided the three balls fall within a maximum deviation criteria. The length of the incline is 30 inches or 2.5 feet. The height of the ball where it releases is 2.5 feet*sin(20 degrees) or 0.855 feet.

A ball of mass m, and height h on an incline has initial potential energy of mgh, where g is the gravatational constant. At the top of the incline, just prior to release, the ball has zero rotational kinetic energy and zero regular kinetic energy. At the bottom of the inclined plane, the ball has zero potential energy, $(1/2)mv^2$ regular kinetic energy and $(1/2)\ I\omega^2$ rotational kinetic energy where I is the centroidal moment of inertia of the rolling object and $\omega$ is angular velocity. Using conservation of energy, which states that the total initial energy of the ball at the top of the incline equals the total energy at the bottom of the incline, the following equation applies: $mgh=(1/2)mv^2+(1/2)I\omega^2$.

The centroidal moment of inertia for a uniform spherical object is $(2/5)mr^2$ where r is the radius of the sphere. Also, relating the angular velocity $\omega$ to linear velocity, $\omega=v/r$. Substituting $I=(2/5)mr^2$ and $\omega=v/r$ gives: $mgh=(1/2)mv^2+(1/2)[(2/5)mr^2][v^2/r^2]$ or $mgh=(1/2)mv^2+(1/5)mv^2=(7/10)mv^2$. Solving for v: $v=[(10/7)gh]^{1/2}=[(10/7)*32.2\ ft/sec^2*0.855\ ft]^{1/2}=6.27\ ft/sec$.

Therefore, a ball will roll at a speed of 6.27 ft/sec emerging from the bottom of a stimpmeter raised to an angle of 20 degrees. Solving for $\mu$ in the equation Distance=v2/(2 g$\mu$), $\mu=v^2/(Distance*2*g)$. For a roll distance of 1 foot on a green whose stimp value is 1.0, the coefficient of friction would be: $\mu=(6.27\ ft/sec)^2/(1\ ft*2*32.2\ ft/sec^2)=0.611$. Therefore, the stimp value, stimp, is related to the coefficient of friction by the factor: $\mu=0.611/stimp$. The coefficient of friction $\mu$, is equal to 0.611 divided by the stimp value. Replacing $\mu$ with 0.611/stimp, the following equation relates rolling distance to initial ball speed: $Distance=(v^2*stimp)/(64.38*0.611)$ or $(v^2*stimp)/39.31$.

Therefore, given an initial ball speed as measured by doppler microwave speed sensor 34 (shown in FIG. 5) and based on the selected green speed setting 28 (shown in FIG. 5) in stimp units, the estimated roll distance can be calculated and displayed. For instance, if the speed of the ball were measured at 12.54 ft/sec for a stimp value of 10, the distance rolled would be $(12.54\ ft/sec^2)*(10)/39.31=40$ feet. After the distance calculation rounded up to the nearest foot has been completed, it is output to the two digit display.

As shown in FIG. 2, beeper 54 provides an audio indication of the simulated roll duration of golf ball 50 past impact with strike plate 22. As shown in FIG. 5, microcontroller 48 controls beeper 54. As shown in step 109 (shown in FIG. 8), an audible beep is output to the golfer after the distance has been calculated and displayed, for every quarter turn of the simulated roll of the golf ball until the golf ball stops. In this embodiment, the ball roll progress increment is a quarter turn, however any increment could be chosen such as 1 full turn, a half turn, or one eighth of a turn. The diameter of a standard golf ball is 1.68 inches. The circumference of a golf ball is $\pi d$, where d is the diameter. A quarter turn of a golf ball is therefore $((\pi 1.68\ in)/4)/12\ in./ft.=0.11$ feet. Knowing the total distance that the golf ball will roll, $d_{TOTAL}$, the initial speed of the rolling golf ball, $v_o$, the coefficient of friction in terms of the Stimp value, 0.611/stimp, and the linear length of a quarter turn of a standard golf ball, 0.11 feet, the time duration of each quarter turn of the rolling golf ball can be calculated. The following equation relates the distance rolled to the initial velocity, the acceleration of the golf ball, and the time. $s=s_o+v_ot+(1/2)at^2$ where $s_o$ is the initial position of the ball, $v_o$ is the initial ball speed, t is the time to reach distance s, and a is the acceleration. The uniform acceleration of a rolling golf ball due to the frictional force of the green is: $a=-v_o^2/(2d_{TOTAL})$. Substituting $a=-v_o^2/(2d_{TOTAL})$ into $s=s_o+v_ot+(1/2)at^2$, $s=s^o+v_ot-(v_o^2/(4d_{TOTAL}))t^2$ or, re-arranging, $-(v_o^2/(4d_{TOTAL}))t^2+v_ot-s+s_o=0$. Recognizing that the derived equation is quadratic, the solution to a quadratic equation of the form $ax^2+bx+c=0$ is: $x=(-b+-(b^2-4ac)^{1/2})/2a$. Applying the quadratic solution equation to solve for time t, the time t to roll distance s is $t=(-v_o+(v_o^2-sv_o/d_{TOTAL})^{1/2})/(-v_o^2/(2d_{TOTAL}))$. Using this equation, the time between each distance increment of 0.11 feet is calculated. The timer in the microcontroller is set for each quarter turn roll duration estimated time. At the end of each timeout, the microcontroller software outputs a short pulse burst to the beeper which creates an audible beep. Referring to FIG. 2, after rolling golf ball 50 impacts strike plate 22, the path of the simulated golf ball then begins to roll past strike plate 22 and the golfer is provided with aural feedback as to the progress of the simulated rolling ball's progress. As the simulated ball rolls, the time between quarter turn beeps gets longer until the ball finally stops and the beeps cease. The aural beeps thus provide the golfer with a feel for the distance that the ball would have traveled in addition to the visual numeric distance display. One skilled in the art will recognize other ways of communicating the simulated golf ball's rolling progress to the golfer such as a flashing LED or a graphical depiction of a rolling golf ball on a personal computer screen. After the distance has been displayed and an audible beep has been output for every quarter turn of the simulated roll of the golf ball, all memory variables are reset and interrupts INT0 and INT1 are re-enabled to begin another distance estimation process after the next putt.

Figure 11:
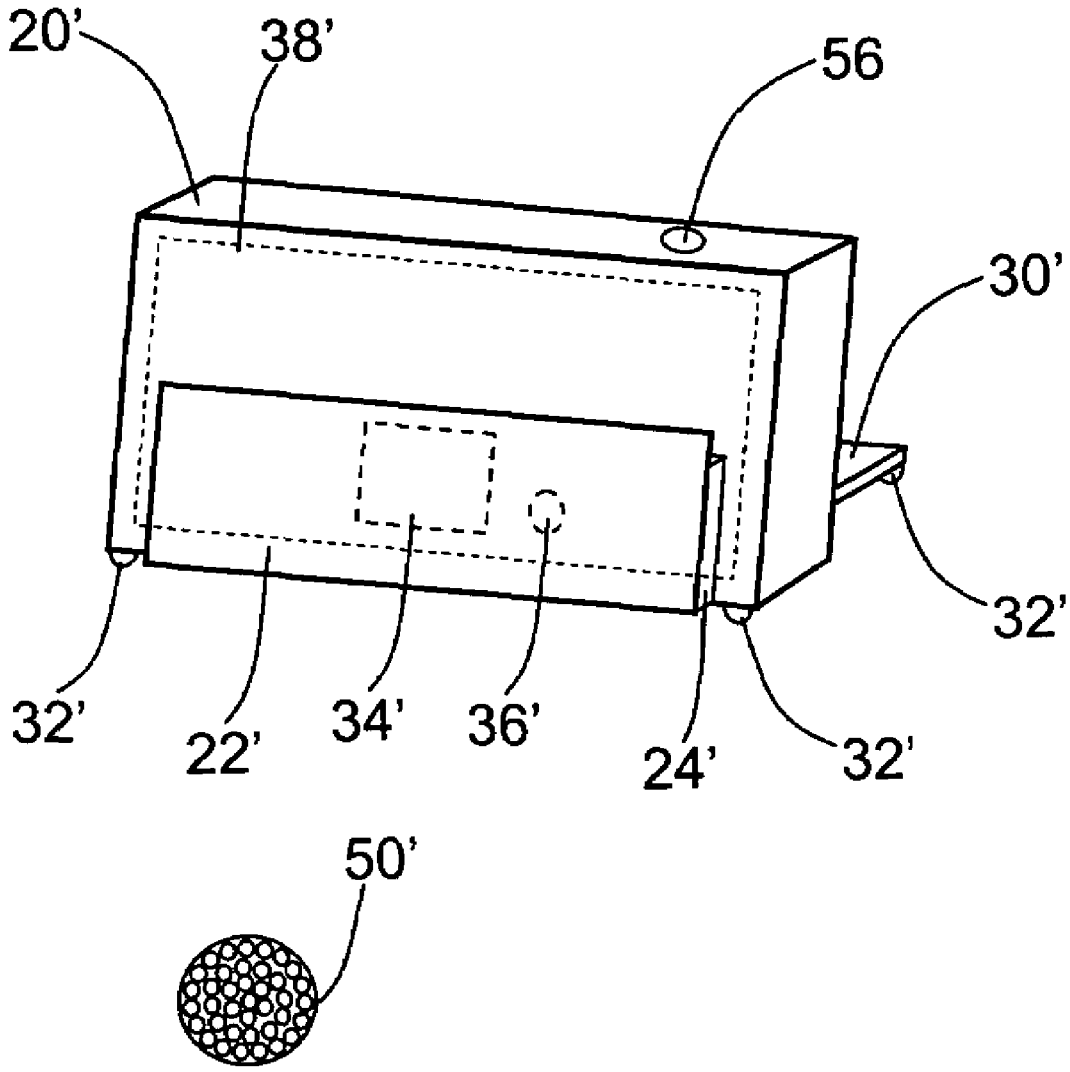
FIG. 11 is a perspective view of an alternate embodiment of the putting distance control trainer device showing the interior mounted dopper microwave speed sensor, impact detection microphone sensor, and printed circuit board parts in broken lines.
Figure 12:
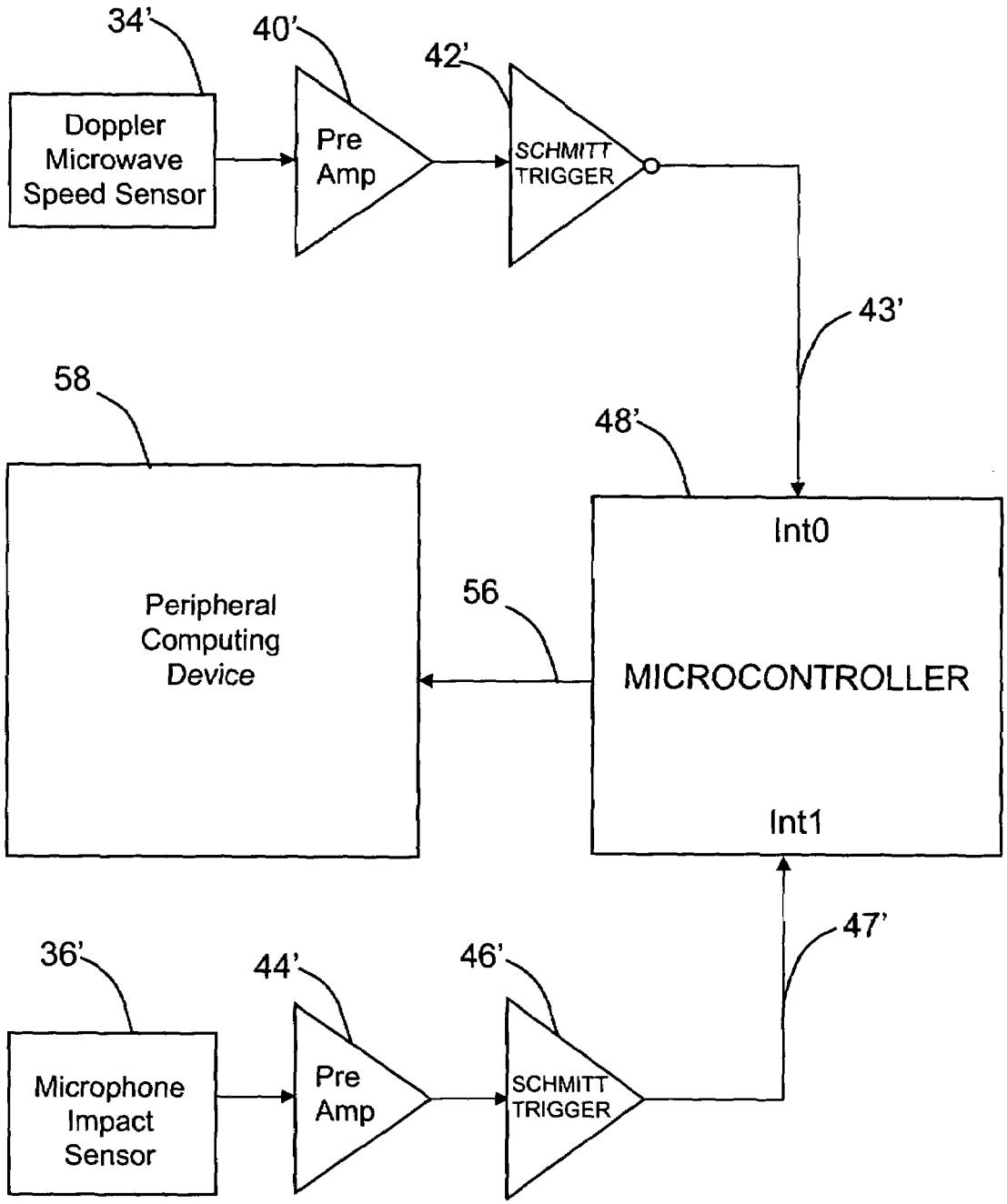
FIG. 12 is a schematic block diagram of the major electronic elements comprising an alternate embodiment of the putting distance control trainer device.
Figure 13:
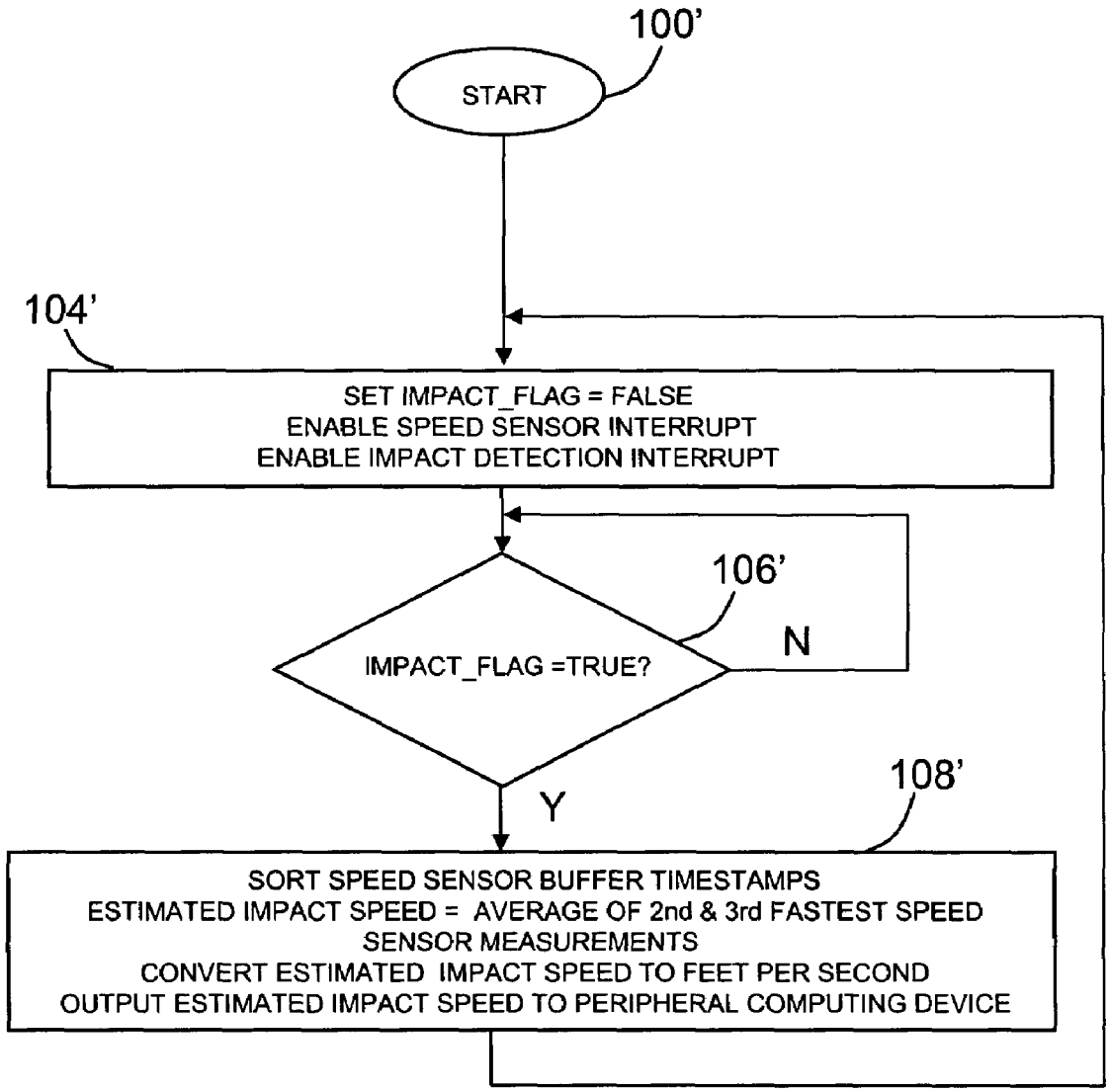
FIG. 13 is a flow chart of the operations that comprise the main background microcontroller software processing for an alternate embodiment of the putting distance control trainer device.

Referring to FIG. 11, an alternate embodiment of the putting distance control training device is shown. In this embodiment, the distance control training device estimates the impact speed of the rolling golf ball and transmits the speed over a serial port to a peripheral computing device which calculates and displays the estimated ball roll distance. Alternate embodiment includes housing 20', bumpers 32', target strike plate 22', impact absorbing material 24', doppler microwave speed sensor 34', microphone impact detection sensor 36', printed circuit board 38', and peripheral serial interface port 56. The major electronic elements for the alternate embodiment as shown in FIG. 12 include doppler microwave speed sensor 34' and associated preamplifier 40' and schmitt trigger 42', microphone impact sensor 36' and associated preamplifier 44' and schmitt trigger 46', microcontroller 48', peripheral serial interface signal 56, and peripheral computing device 58. The output of schmitt trigger 42' is the INT0 43' digital signal that interrupts microcontroller 48'. The output of schmitt trigger 46' is the INT1 47' digital signal that interrupts microcontroller 48' when an impact of golf ball 50' (shown in FIG. 11) with the target strike plate 22' (shown in FIG. 11) occurs. Referring to FIG. 13, main background software processing 100' clears IMPACT_FLAG to FALSE and enables both the speed sensor and impact detection sensor interrupts in step 104'. In step 106', IMPACT_FLAG is checked for a TRUE condition. Upon impact of the rolling golf ball with the target strike plate, IMPACT_FLAG is set to TRUE by microphone impact interrupt service routine. When step 106' detects IMPACT_FLAG has been set to TRUE, step 108' is performed. In step 108', the most recent n/2 speed sensor buffer timestamps are sorted from shortest to longest period. The second and third shortest periods are averaged to form the composite period of the microwave speed sensor digital signal at impact. The reciprocal of this value is the frequency in cycles per second of the microwave speed sensor digital signal at impact. Transforming this quantity to a feet per second quantity requires application of a scaling factor associated with the specific microwave sensor used. As mentioned previously in the preferred embodiment, the scale factor of the X-band sensor is 21.4 Hz per feet per second. Using scale factor 21.4 Hz/ft/sec, the speed of the ball just prior to impact is (1/composite period)/21.4 Hz/ft/sec. The ball impact speed is then output over peripheral serial interface port 56 (shown in FIG. 12) to peripheral computing device 58 (also shown in FIG. 12). Peripheral computing device 58 in this alternate embodiment is a conventional personal computer, personal digital assistant, or video game platform equipped with a serial port or universal serial bus interface. Peripheral computing device 58 receives the ball impact speed, calculates a simulated ball rolling distance using the equation Distance=($v^2$*stimp)/39.31, and outputs the distance to its display. The simulated green speed setting and the configuration of the simulated green are selectable on peripheral computing device 58. Various simulated green configurations are selectable from the peripheral computing device 58.

In View of the foregoing, it will be seen that the object of the invention is achieved. As various changes could be made in the above construction and methods without departing from the scope of the invention, it is intended that all matter contained in the above description or shown in the accompanying drawings shall be interpreted as illustrative and not in a limiting sense.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A golf putting training device comprising:

a housing constructed of material that passes microwave signals from the interior of said housing to an exterior object;

a target strike plate mounted to the front side of said housing which serves as a putting target and receives an impact of a rolling golf ball struck by a golfer with a putter from two feet away, wherein a layer of impact absorbing material is sandwiched between said housing and said target strike plate;

positional stabilization means comprising a weight placed inside said housing and a plurality of bumpers attached to the bottom of said housing;

a doppler microwave speed measurement sensor positioned within said housing behind said strike plate such that emitted microwave energy projects outward through said strike plate on a direct path toward said rolling golf ball, said doppler microwave speed measurement sensor being responsive to movement of said rolling golf ball by providing a doppler audio output signal whose frequency is proportional to the speed of said rolling golf ball;

amplification circuitry to amplify said doppler audio output signal into an amplified doppler audio output signal and conversion circuitry that converts said amplified doppler audio output signal to a doppler microwave speed measurement digital signal;

green speed setting means responsive to selection of a plurality of green speed values and display of said green speed values to said golfer;

an impact detection sensor responsive to said impact of said rolling golf ball with said target strike plate;

amplification circuitry that amplifies said impact detection sensor signal into an amplified impact detection sensor signal and conversion circuitry that converts said amplified impact detection sensor signal to an impact sensor digital signal;

a circular memory buffer comprised of a plurality of random access memory elements into which period measurements of every cycle of said doppler microwave speed sensor digital signal are stored;

a write index which serves as a clockwise storage guide pointing to locations in said circular memory buffer where said period measurements are stored, said write index also serving as a read index in counter-clockwise retrieval of said period measurements from said circular memory buffer upon said impact of said rolling golf ball with said target strike plate;

signal processing means to measure the period of every said doppler microwave speed measurement digital signal and to store said period into said circular memory buffer; said signal processing means further reads said green speed setting means and converts said green speed setting means green speed value into an equivalent coefficient of friction of a surface to be simulated; said signal processing means responds to an interrupt from said impact sensor digital signal upon said impact of said rolling golf ball with said target strike plate; said signal processing means further includes means to access said period measurements from said circular memory buffer using said write index as a counter-clockwise read index, and, means to mathematically operate upon said period measurements; said signal processing means sorts said circular memory buffer from shortest to longest, taking the reciprocal of the average of the second and third shortest said period measurements multiplied by a doppler microwave scaling factor expressed in cycles per second per feet per second resulting in said estimated speed in units of feet per second; said signal processing means further squares said estimated speed into a squared estimated speed, and dividing said squared estimated speed by the product of said coefficient of friction multiplied by two times the earth's gravitational constant of acceleration in feet per second per second to determine an estimated putting distance of said rolling golf ball; said signal processing means further comprising means to output an indication of said rolling golf ball rolling progress wherein said signal processing means communicates said estimated putting distance to said golfer.

2. A golf putting training device comprising:

a housing constructed of material that passes microwave signals from the interior of said housing to an exterior object;

a target strike plate mounted to the front side of said housing which serves as a putting target and receives an impact of a rolling golf ball struck by a golfer with a putter from two feet away, wherein a layer of impact absorbing material is sandwiched between said housing and said target strike plate;

positional stabilization means comprising a weight placed inside said housing and a plurality of bumpers attached to the bottom of said housing;

a doppler microwave speed measurement sensor positioned within said housing behind said strike plate such that emitted microwave energy projects outward through said strike plate on a direct path toward said rolling golf ball, said doppler microwave speed measurement sensor being responsive to movement of said rolling golf ball by providing a doppler audio output signal whose frequency is proportional to the speed of said rolling golf ball;

amplification circuitry to amplify said doppler audio output signal into an amplified doppler audio output signal and conversion circuitry that converts said amplified doppler audio output signal to a doppler microwave speed measurement digital signal;

an impact detection sensor responsive to said impact of said rolling golf ball with said target strike plate;

amplification circuitry that amplifies said impact detection sensor signal into an amplified impact detection sensor signal and conversion circuitry that converts said amplified impact detection sensor signal to an impact sensor digital signal;

a circular memory buffer comprised of a plurality of random access memory elements into which period measurements of every cycle of said doppler microwave speed sensor digital signal are stored;

a write index which serves as a clockwise storage guide pointing to locations in said circular memory buffer where said period measurements are stored, said write index also serving as a read index in counter-clockwise retrieval of said period measurements from said circular memory buffer upon said impact of said rolling golf ball with said target strike plate;

signal processing means to measure the period of every said doppler microwave speed measurement digital signal and to store said period into said circular memory buffer; said signal processing means responds to an interrupt from said impact sensor digital signal upon said impact of said rolling golf ball with said target strike plate by halting said period measurements and starting a speed estimation process; said signal processing means further includes means to access said period measurements from said circular memory buffer using said write index as a counter-clockwise read index, and, means to mathematically operate upon said period measurements; said signal processing means sorts said circular memory buffer from shortest to longest, taking the reciprocal of the average of the second through the third shortest said period measurements multiplied by a doppler microwave scaling factor expressed in cycles per second per feet per second resulting in said estimated speed in units of feet per second; said signal processing means further comprising a peripheral interface port through which said signal processing means transmits said estimated speed;

a green speed setting selector within a personal computer graphical user interface software program allowing selection of a stimp value in which to simulate, said green speed setting selector having a plurality of possible stimp settings for simulating a variety of green speeds, said green speed setting selector being converted into an equivalent coefficient of friction by said personal computer graphical user interface software program;

said personal computer graphical interface software program comprising means to receive said estimated speed of said rolling golf ball from said peripheral interface port of said signal processing means; said personal computer graphical user interface software program further squares said estimated speed into a squared estimated speed, and dividing said squared estimated speed by the product of said coefficient of friction multiplied by two times the earth's gravitational constant of acceleration in feet per second per second to determine an estimated putting distance of said rolling golf ball;

whereby said personal computer graphical user interface software program further comprising means to convey an indication of said rolling golf ball rolling progress wherein said personal computer graphical interface software program communicates said estimated putting distance and outputs a rolling progress to said golfer.

3. The golf putting training device of claim 2 in which the peripheral interface port is a universal serial bus.

4. A method of estimating the projected roll distance of a golf ball past an impact point with a target strike plate placed two feet from the golf ball's starting position, the golf ball having been struck by a golfer with a putter, and, conveying the estimated distance and an indication of the golf ball's rolling progress to the golfer comprising the steps of:

providing a housing that includes a ball impact strike plate, a doppler microwave speed measurement sensor, doppler microwave speed measurement amplifier and schmitt trigger, impact sensor and associated amplifier and schmitt trigger, microcontroller, green speed setting switch, circular memory buffer; an internal weight, bumpers mounted on the bottom side of the housing, and a display for outputting the estimated roll distance;

positioning the housing two feet from the starting position of the golf ball such that the impact strike plate is orthogonal to the intended path of the golf ball so that a golfer can putt a golf ball and cause a collision of the rolling golf ball with the impact strike plate;

positioning the doppler microwave speed measurement sensor behind the impact strike plate within the housing such that the rolling golf ball is illuminated by the doppler microwave speed measurement sensor which provides an audio output signal indicative of the golf ball's speed;

amplifying the doppler microwave speed sensor audio output signal and converting the amplified doppler microwave speed sensor audio output signal to a digital signal by connecting it to a schmitt trigger; the output of the schmitt trigger connecting to a first interrupt pin of a microcontroller that responds to each negative edge of the microwave speed sensor digital signal, the time between each negative edge being the period;

positioning an impact sensor within the housing to respond with a signal when the impact strike plate is struck by the rolling golf ball;

amplifying the impact sensor signal and converting the amplified impact sensor signal to a digital signal by connecting it to a second schmitt trigger; the output of the second schmitt trigger connecting to a second interrupt pin of the microcontroller;

processing the doppler microwave speed sensor digital signal by storing the elapsed time between interrupt negative edges into a circular memory buffer for any movement of any object within the doppler microwave speed sensor's field of view;

processing the impact detection interrupt by hafting any further interrupts of the doppler microwave speed sensor digital signal, and starting at the most recent elapsed time stored and working backwards, select the newest elapsed time measurements from the circular memory buffer that represent the speed of the rolling ball just prior to impact with the impact strike plate;

converting the green speed setting switch value into an equivalent coefficient of friction value used in the determination of the golf ball rolling distance estimation step;

determining the estimated rolling golf ball speed by sorting the elapsed time measurements in descending order from shortest to longest and taking the reciprocal of the average of the second and third shortest elapsed time values;

the reciprocal, then being multiplied by a doppler microwave speed sensor constant to obtain an estimated rolling golf ball speed in feet per second;

determining an estimated golf ball rolling distance that the golf ball would have rolled past the impact strike plate by squaring the estimated rolling golf ball speed into a squared estimated speed, and dividing the squared estimated speed by the product of the coefficient of friction multiplied by two times the earth's gravitational constant of acceleration in feet per second per second; and, outputting a rolling progress indication and the estimated golf ball roll distance to a golfer.

* * * * *